US011649749B2

(12) United States Patent
Bell, Jr.

(10) Patent No.: US 11,649,749 B2
(45) Date of Patent: May 16, 2023

(54) AIR INLET DEVICE FOR AN OIL SYSTEM IN AN INTERNAL COMBUSTION ENGINE

(71) Applicant: Lewis P. Bell, Jr., Gainesville, GA (US)

(72) Inventor: Lewis P. Bell, Jr., Gainesville, GA (US)

(73) Assignee: PREFERRED RENOVATIONS, LLC, Gainesville, GA (US)

( * ) Notice: Subject to any disclaimer, the term of this patent is extended or adjusted under 35 U.S.C. 154(b) by 0 days.

(21) Appl. No.: 17/738,073

(22) Filed: May 6, 2022

(65) Prior Publication Data

US 2022/0259993 A1 Aug. 18, 2022

Related U.S. Application Data

(63) Continuation-in-part of application No. 16/534,303, filed on Aug. 7, 2019, now Pat. No. 11,352,920.

(60) Provisional application No. 62/716,126, filed on Aug. 8, 2018.

(51) Int. Cl.

| | |
|---|---|
| ***F02F 3/00*** | (2006.01) |
| ***F01M 13/02*** | (2006.01) |
| ***F01M 13/04*** | (2006.01) |
| ***F02M 35/10*** | (2006.01) |

(52) U.S. Cl.

CPC ..... *F01M 13/023* (2013.01); *F01M 13/04* (2013.01); *F02M 35/10222* (2013.01); *F01M 2013/0433* (2013.01); *F01M 2250/00* (2013.01)

(58) Field of Classification Search

CPC ..... F02M 35/10262; F02M 35/0216; F15D 1/04; F15D 1/02; F16L 43/00

USPC ..... 123/193.6

See application file for complete search history.

(56) References Cited

U.S. PATENT DOCUMENTS

| | | | | |
|---|---|---|---|---|
| 3,369,695 | A * | 2/1968 | Johnson | B60K 15/04 141/300 |
| 3,374,775 | A | 3/1968 | Ferguson | |
| 5,840,198 | A | 11/1998 | Clarke | |
| 5,912,368 | A * | 6/1999 | Satarino | B01D 46/30 55/444 |
| 6,668,580 | B2 * | 12/2003 | MacBain | F16L 43/001 138/37 |
| 2007/0175186 | A1 * | 8/2007 | Braziunas | B01D 45/06 55/385.3 |
| 2008/0190683 | A1 | 8/2008 | Hoeve | |
| 2011/0061635 | A1 * | 3/2011 | Bukhenik | F02M 25/06 123/573 |
| 2015/0267655 | A1 | 9/2015 | Madeira | |
| 2018/0057335 | A1 * | 3/2018 | Ploeger | B67C 11/02 |

* cited by examiner

*Primary Examiner* — Long T Tran
*Assistant Examiner* — James J Kim
(74) *Attorney, Agent, or Firm* — Buchanan Ingersoll & Rooney PC

(57) ABSTRACT

An apparatus that improves the gas mileage of an internal combustion engine in a vehicle is disclosed that is comprised of an air inlet, a condensation chamber, and an air outlet that is connected to the vehicle's oil system through an oil filler port in the engine of the vehicle.

8 Claims, 6 Drawing Sheets

AIR INLET DEVICE FOR AN OIL SYSTEM IN AN INTERNAL COMBUSTION ENGINE

The present application is a continuation-in-part application of co-pending U.S. Non-Provisional patent application Ser. No. 16/534,303, filed on Aug. 7, 2019, which is based on and claims the benefit of U.S. Provisional Patent Application No. 62/716,126, filed on Aug. 8, 2018, the contents of which are hereby incorporated herein by reference in their entirety.

FIELD OF THE INVENTION

The present invention generally relates to an apparatus connected to an oil system for an internal combustion engine.

BACKGROUND OF THE INVENTION

Almost all cars and trucks currently use what is called a four-stroke combustion cycle (the Otto cycle) to convert gasoline into motion. The four strokes consist of an intake stroke, a compression stroke, a combustion stroke, and an exhaust stroke. The present invention is focused on the combustion stroke and permits an additional amount of unforced fresh air through the valves into the combustion chamber in an engine at the moment that the spark plug ignites the gasoline in the chamber to increase the overall efficiency and extent of the combustion in the engine.

In a four-stroke engine, the piston starts at the top of the engine block. When the intake valve opens during the intake stroke, the piston moves down to allow air and gasoline into the cylinder. During the compression stroke, the piston moves back up, thereby compressing the gasoline and air into a more efficient and powerful fuel/air mixture. When the piston reaches the top of its stroke, the spark plug emits a spark that ignites the fuel/air mixture and creates an explosion that forces the piston down (the combustion stroke). Once the piston reaches the bottom of its cycle, the exhaust valve opens and vents the cylinder of the combustion residue (the exhaust stroke). The precise fuel/air mixture during the combustion cycle affects the efficiency of the engine, which in turn affects the gas mileage of the vehicle. Increasing the efficiency of an engine is highly desirable, because it reduces the cost to operate the engine and results in fewer harmful emissions from the engine during operation. An engine that more efficiently burns its fuel will emit fewer harmful byproducts and will use less fuel during operation.

While typically found in automobiles and trucks, internal combustion engines are also used in other types of applications, such as to power boats, tractors, lawn mowers, powered garden tools, and generators, among others.

Thus, there exists a need for accessories that can be used in conventional vehicles and devices with internal combustion engines to improve their efficiency and performance.

SUMMARY OF THE INVENTION

The present invention allows additional fresh air to enter into the combustion cycle through the oil system, thereby adjusting the fuel/air mixture during in the combustion stroke to create a more efficient use of the fuel (which also raises the effective gas mileage of the vehicle). The present invention is comprised of a device that attaches to the oil filler port found on most internal combustion engines. In most vehicles, there is an oil filler port located near the top of the engine that allows an individual to put oil in the engine. This oil filler port is normally sealed by an oil cap.

The device contains an air intake port, which allows fresh air to passively enter into the engine oil system without the need for additional electronics or dynamic components, a section of tubing, which forms a condensation chamber and allows air into the oil system without allowing appreciable amounts of engine oil to leave the oil system, and a mechanism to connect the device to the oil system via the oil filler port once the oil cap has been removed. The device is small enough to be mounted on the oil filler port without requiring additional modifications of the engine or vehicle.

An apparatus for improving the efficiency of an engine, comprising: a tubular chamber comprised of a first end and a second end, said first and second ends being at opposite ends of the tubular chamber, a plurality of tubular angular sections connecting the first end and the second end, and a plurality of baffles connected to the inside of the tubular chamber; an air inlet at the first end of the tubular chamber; and an air outlet at the second end of the tubular chamber.

A system for improving the efficiency of an engine, comprising: an engine with an oil system, an oil filler port connected to the oil system, and an apparatus comprised of a tubular chamber comprised of a first end and a second end, said first and second ends being at opposite ends of the tubular chamber, a plurality of tubular angular sections connecting the first end and the second end, and a plurality of baffles connected to the inside of the tubular chamber; an air inlet at the first end of the tubular chamber; and an air outlet at the second end of the tubular chamber, wherein the air outlet is connected to the oil filler port.

A method for improving the efficiency of an engine, comprising: removing an oil cap from an oil filler port of an oil system in an engine, inserting an apparatus comprised of a tubular chamber comprised of a first end and a second end, said first and second ends being at opposite ends of the tubular chamber, a plurality of tubular angular sections connecting the first end and the second end, and a plurality of baffles connected to the inside of the tubular chamber; an air inlet at the first end of the tubular chamber; and an air outlet at the second end of the tubular chamber, by connecting the air outlet to the oil filler port.

DESCRIPTION OF THE INVENTION

Figure 1:
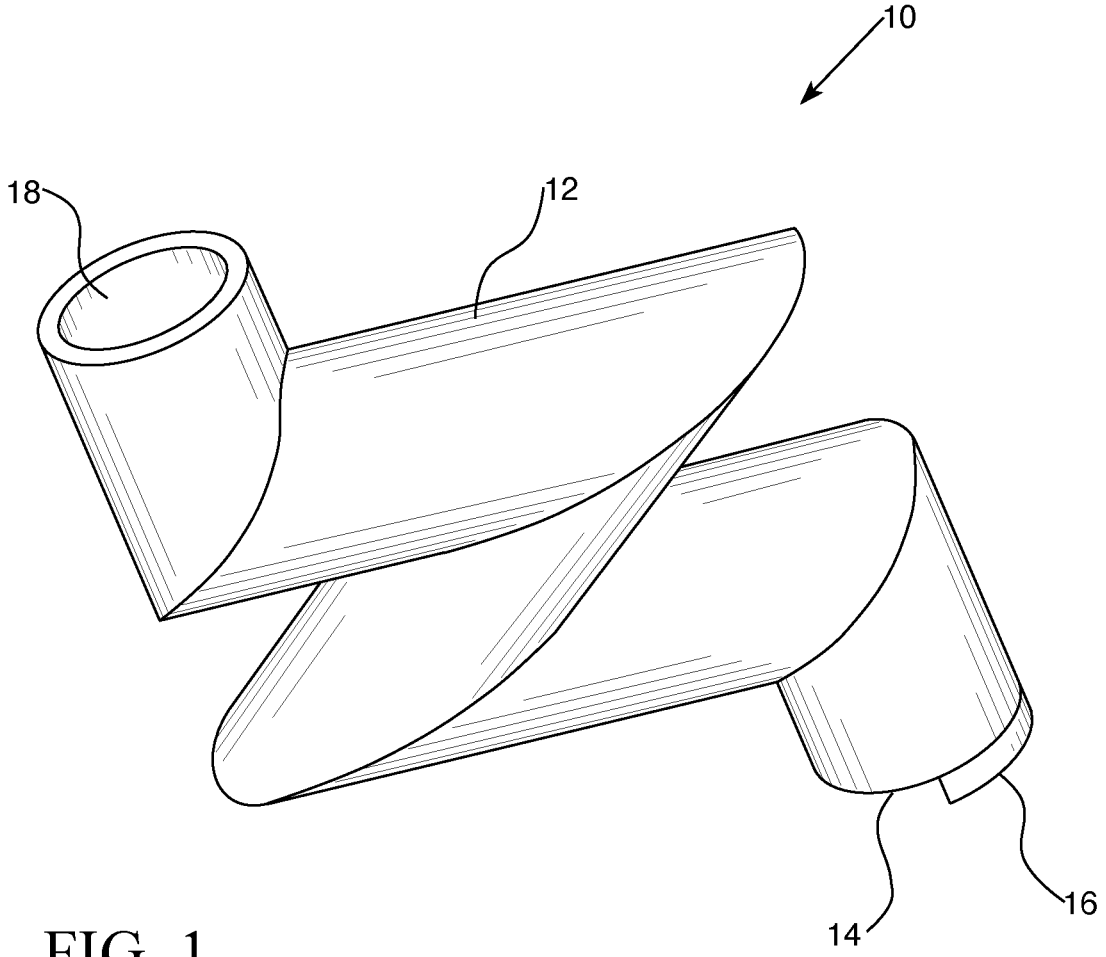
FIG. 1 is a perspective view of the underside of one embodiment.

As shown in the various embodiments shown in FIGS. 1-4, device 10 is comprised of a folded tubular chamber 12, an air inlet 14 at one end of tubular chamber 12, and an air outlet 18 at the opposite end of tubular chamber 12. As shown in FIG. 6, device 10 is attached to oil filler port 28 on a typical internal combustion engine 24 by removing the standard oil cap 26 (shown in FIG. 5) and inserting the air outlet 18 end of device 10 into oil filler port 28. The precise connection between device 10 and oil filler port 28 will vary depending on the precise design and form of oil filler port 28. In some embodiments, a rubber gasket 20 at the air outlet 18 end of device 10 fits into oil filler port 28, but other mechanisms, such as a rubberized sleeve 19 around air outlet 18, a tapered air outlet 18, or a threads 21 on the outside of air outlet 18 that match the threads of oil filler port 28, among others, could be used and fall within the scope of the invention.

In one embodiment, folded tubular chamber 12 is comprised of a 1" diameter rigid plastic tube, such as a standard PVC pipe, but it can be made from other rigid materials that can withstand the environmental conditions under the hood of a vehicle, such as metal, composites, ceramics, or other plastic materials. As shown in FIG. 1, folded tube 12 is comprised of different angular sections of PVC pipe that have been cut and glued together to form the general shape of the letter "Z" with vertical protrusions near the inlet and outlet sections. The overall dimension of one embodiment of device 10 is approximately 3" high×3" wide×1" deep. Other shapes and sizes of tubing could be used and fall within the scope of the invention. For instance, a larger or smaller diameter tube could be used, the tubing could have a cross-section that is round, oval, rectangular, or another shape, or the folded tube could be in the form of a horizontal "V" or have additional vertexes or shapes (such as a stretched, curved "S" shape). In another embodiment, the apparatus could be angled rather than being in the vertical orientation perpendicular to the surface of the engine when installed (as shown in FIG. 6), or the tubes could be split into multiple tubes that extend at angles to either side of the vertical. Moreover, the overall size of device 10 can vary to accommodate its placement on the engine.

Once oil cap 26 has been removed from the engine to allow additional air into the engine, there exists a pathway for oil to escape from the engine through oil filler port 28 and device 10. It is desirable that the oil within the oil system in the engine remains in the engine and does not escape through device 10, however. In order to minimize the risk and extent of oil escaping, various features have been added to device 10 to block or reduce the flow of oil out of oil filler port 28 and to cause oil to collect on internal features within device 10 and drip back into the engine. These same systems that reduce the amount of oil exiting the engine can also reduce the amount of contaminants (such as dust, dirt, and debris) that enter into air inlet 14.

Figure 2:
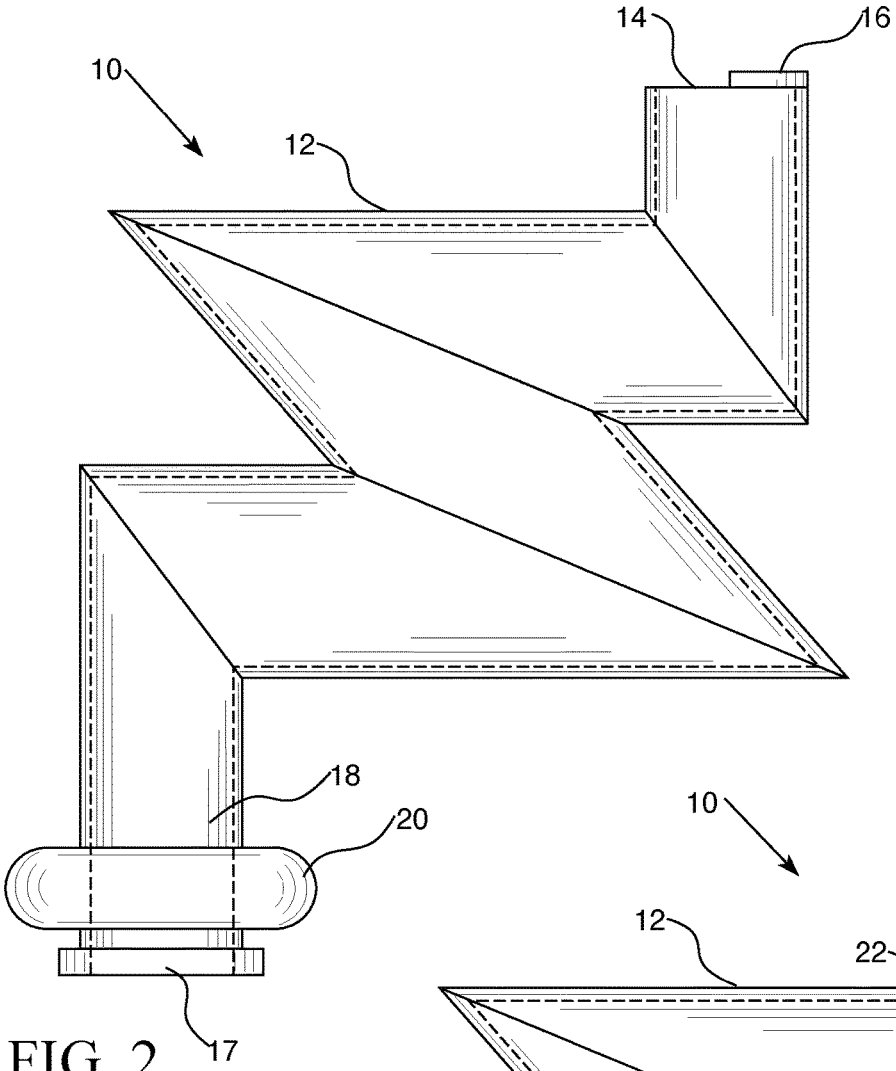
FIG. 2 is a cross-sectional side view of one embodiment.
Figure 3:
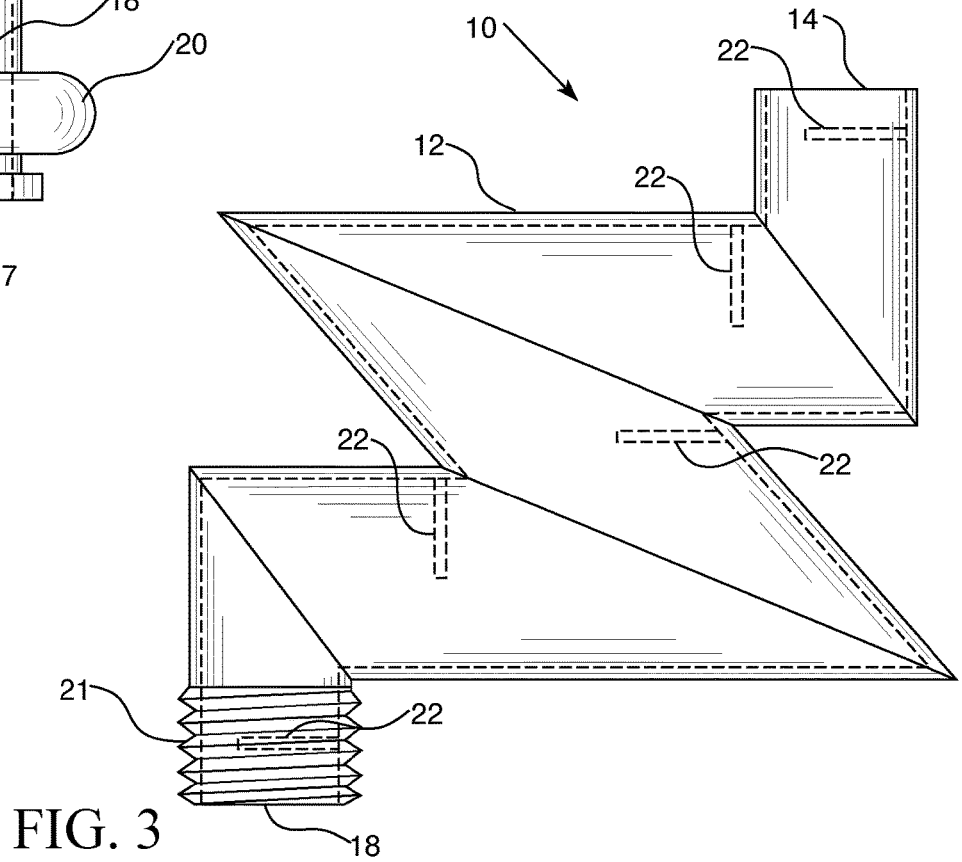
FIG. 3 is a cross-sectional side view of one embodiment.
Figure 4:
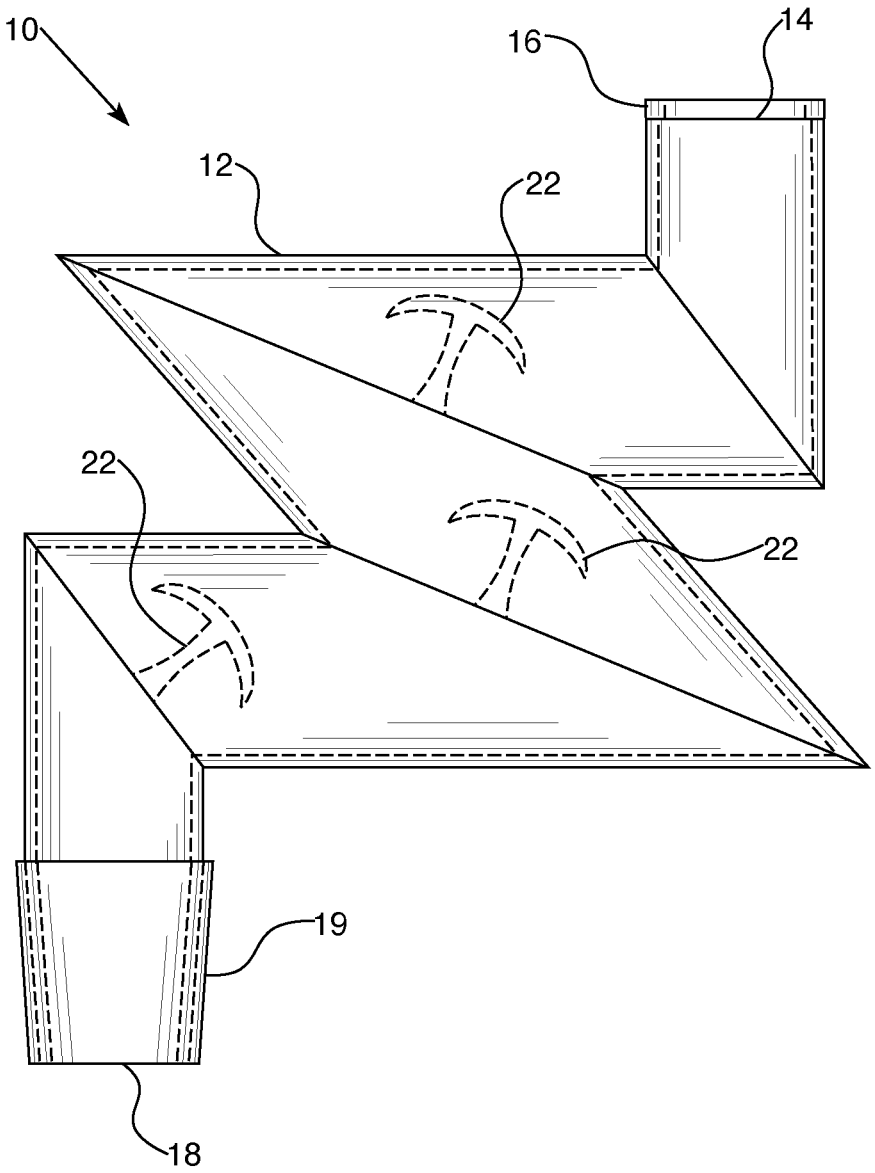
FIG. 4 is a cross-sectional side view of one embodiment.

For instance as shown in FIGS. 2 and 4, an air inlet cover 16 partially blocks air inlet 14 to still allow air into device 10 and engine 24, but minimizes the pathway for oil to escape or contaminants to enter. In one embodiment shown in FIGS. 2 and 6, inlet cover 16 is a partially truncated plastic disc that covers approximately 60% of air inlet 14. Inlet cover 16 can be formed in other shapes (e.g., a circular ring, grid, or other shapes) and can cover different percentages of air inlet 14 (either greater or less than 60%) and still fall within the scope of the invention. In addition, inlet cover 16 can be made from other materials, such as metal, composite, ceramic, or other plastics, or could be integral with air inlet 14 and fall within the scope of the invention. As shown in FIG. 3, device 10 will also function without inlet cover 16. Alternatively, or in addition to a solid inlet cover, inlet cover 16 could be formed from a mesh or screen that either totally or partially covers air inlet 14 or covers the exposed portion of air inlet 14 in the case where there is also a solid inlet cover 16. Such a screen could be made from wire, metal, fabric, or plastic, among other things, and could be made from various different mesh sizes.

In addition and as shown in FIGS. 3 and 4, internal baffles 22 can be placed inside tube 12 such that tube 12 acts as a condensation or collection chamber in addition to allowing air to flow through it. These baffles 22 act to alter the fluid flow through tube 12 by redirecting the fluid (either gas or liquid) inside tube 12. Baffles 22 provide a surface on which oil droplets or vapor can collect or condense and then drip back down into engine 24 via outlet 18. Preferably, baffles 22 are oriented in such a fashion that they do not locally trap oil in pockets or voids near the baffles. Instead, any oil that drips off of baffles 22 has a path back to outlet 18 and engine 24 through tube 12. Various shapes and locations of representative baffles 22 can be used. For instance, baffles 22 can be semi-circular disks (FIG. 3), umbrella-like extensions (FIG. 4), spheres, oblong spheroids, or crescent shaped, among other things. Baffles 22 can also have cut-outs or holes within them to better allow the flow of oil back to the engine. While FIGS. 3 and 4 show representative examples of some of the baffles 22 in particular locations and orientations, one of ordinary skill in the art would recognize that the baffles can be placed in other locations and in other orientations and fall within the scope of the invention. Similarly, other shapes, sizes, and numbers of baffles (including a single baffle) can be used and fall within the scope of the invention. Baffles 22 can be made from a variety of materials, such as plastics, metal, composites, or ceramics, among other things. Baffles 22 can be formed as an integral part of tube 12 or can be attached to tube 12 by various means (such as epoxy, glue, welds, rivets, nuts/bolts, etc.). The size of the baffles is such that there is still an overall clearance within tube 12 of approximately 0.25-0.375", although other clearances (either greater or less) would still fall within the scope of the invention.

While preferred, neither inlet cover 16 nor baffles 22 are required for the invention to operate. In addition, only one of inlet cover 16 or baffles 22 could be used and fall within the scope of the invention. For example, FIG. 2 shows an embodiment with an inlet cover 16, but no baffles 22. FIG. 3 shows an embodiment with no inlet cover 16, but with baffles 22.

In one embodiment shown in FIG. 2, there is a lip 17 at the end of air outlet 18. Above lip 17 is rubber gasket 20. Lip 17 helps to contain gasket 20 on air outlet 18 during insertion or removal of device 10 from oil filler port 28 and thereby prevent gasket 20 from falling into or becoming stuck inside oil filler port 28. Gasket 20 can be made of a resilient material such as rubber or another pliable material that can form a seal between air outlet 18 and oil filler port 28. Air outlet 18 can be inserted into oil filler port 28 by hand, and gasket 20 provides enough frictional connection such that device 10 remains connected to oil filler port 28 during normal operation of the vehicle.

In another embodiment shown in FIG. 3, the outer portion of the air outlet 18 end of tubular chamber 12 is threaded with threads 21 that match the internal threads in the opening in oil filler port 28. Air outlet 18 can be inserted into oil filler port 28 by rotating device 10 until the device is securely connected to the engine.

In yet another embodiment shown in FIG. 4, the outer portion of the air outlet 18 end of tubular chamber 22 is covered in a resilient material 19 and tapered to match the diameter of the opening in oil filler port 28. Air outlet 18 can be inserted into oil filler port 28 by hand, and the resilient material covering on air outlet 18 provides enough frictional connection such that device 10 remains connected to oil filler port 28 during normal operation of the vehicle. Instead of being tapered, the air outlet 18 end of tubular chamber 22 may also be of uniform diameter and covered with resilient material 19.

Figure 8:
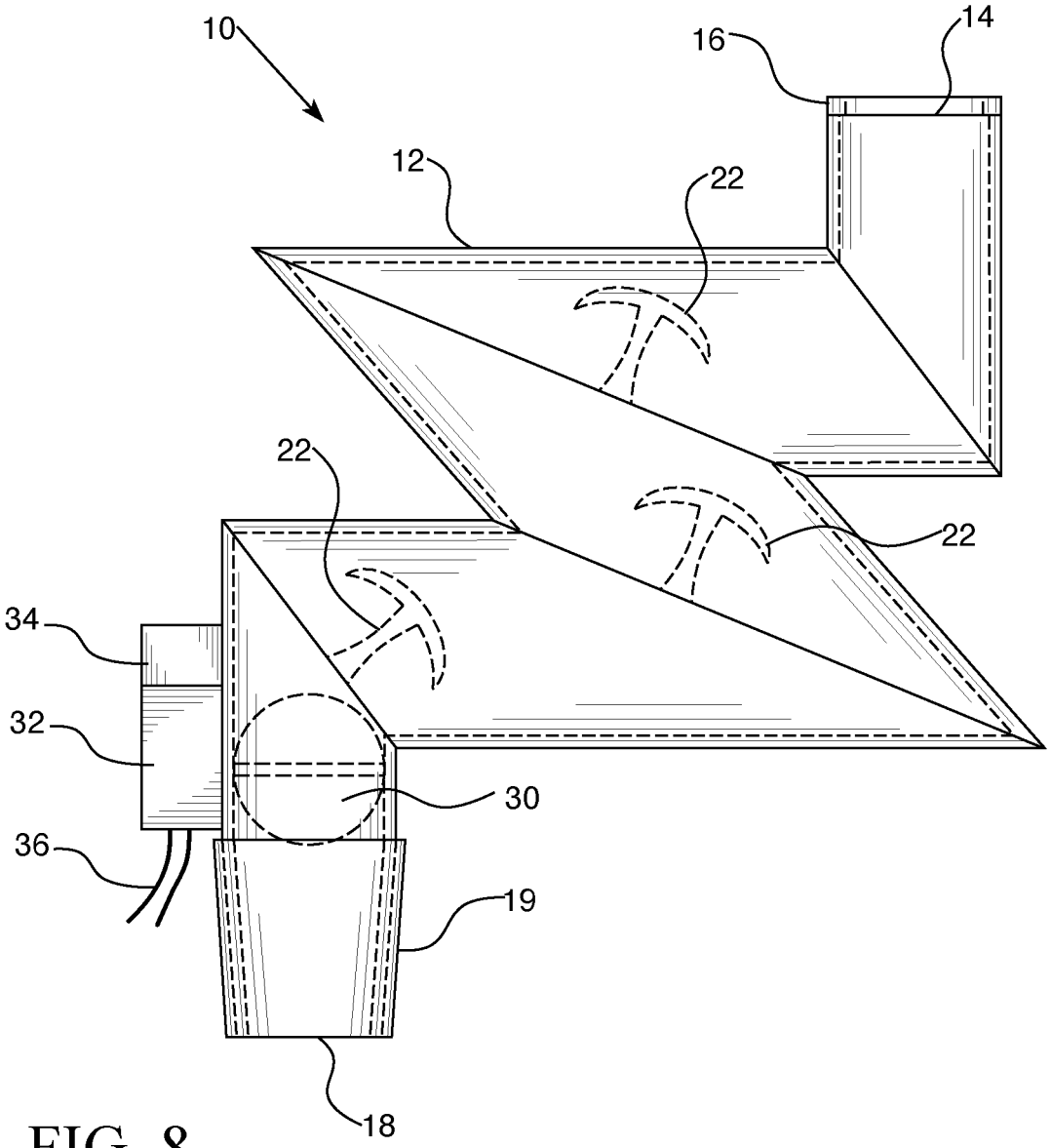
FIG. 8 is a cross-section side view of one embodiment.

In still another embodiment shown in FIG. 8, butterfly valve 30 is placed inside tubular chamber 12 near air outlet 18 and connected to control 32, which is coupled to sensor 34 (such as a tilt-sensor) to detect when the engine or device 10 is inclined at a large triggering angle (e.g., greater than approximately 33° on any axis relative to its standard horizontal position), in order to prevent oil from leaking out of the oil system through device 10 due to gravity. When sensor 34 detects that the engine is inclined at such a large angle, control 32 closes valve 30, thereby closing off tubular chamber 12 and preventing oil from escaping the system due to gravity. When sensor 34 detects that the engine is no longer inclined at such a large angle, control 32 reopens valve 30. Control 32 contains additional components necessary to detect the orientation of device 10 and actuate valve 30, such as a microprocessor, circuitry, motors, solenoids, actuators, etc., in addition to electrical leads 36 that connect to the electrical system of the vehicle or device to provide power to the various components. Sensor 34 can also contain a power sensor that detects when the engine is off, and control 32 can be programmed to close valve 30 when sensor 34 detects that the engine is off, thereby preventing contaminants from entering the oil system when the engine is not being used.

One of skill in the art would recognize that various different types of valves (such as butterfly, gate, plug, ball, etc.), controls (microprocessor, circuitry, motors, solenoids, actuators, etc.), sensors (such as accelerometers, gyroscopes, inclinometers, magnetic, etc.), triggering angles (such as between 15°-45°, etc.), and power sources (such as a battery) could be used with this embodiment that fall within the scope of the invention. In addition, valve 30 can be located at different positions within tubular chamber 12, such as in the middle or towards air inlet 14. In this embodiment, tubular chamber 12 is made from stainless steel and coated with a silicon solution to avoid corrosion and to provide better support for valve 30, although this embodiment could be made from different materials and still fall within the scope of the invention. While this embodiment is particularly useful for marine applications when engines can be subjected to a large range of motion, it is also useful in other applications when engines may be inclined at large angles—such as with cars parked on steep hills, lawn mowers used on steep gradients, and powered lawn tools that are swung through large angles, among others.

In all of these embodiments, the connection point with oil filler port 28 is such that device 10 will remain attached to the engine during normal operations and will also form a sufficient seal that oil will not escape from the engine at the oil filler port 28-air outlet 18 connection point. In any of these embodiments, device 10 can be rotated so that device 10 is in the orientation desired by the user, which may depend on factors such as the location of other components in the engine and obstructions they may cause, clearance with the hood, or ascetic preferences, among other things. One of skill in the art would recognize that the diameter and threads of air outlet 18 may vary in order to accommodate the precise size and threading of oil filler ports found in different engines and fall within the scope of the invention.

One embodiment of the invention has been tested on three vehicles: a 1985 Chevrolet Silverado, 1998 Oldsmobile Intrigue, and a 2006 Kia Sportage. Initial testing has revealed that the present invention has increased the effective gas mileage of a vehicle by 15-33% under typical road conditions. While initially intended to be used with internal combustion engines found in vehicles, the present invention can also be used with other types of internal combustion engines, such as those found in boats, generators, portable tools and devices, lawn mowers, and pumps, among other things.

Device 10 can form a system with internal combustion engine 24 that increases the fuel efficiency and performance of engine 24. Such a system comprises the standard components of the engine, including its oil system, which includes oil filler port 28, except that oil cap 26 is removed from oil filler port 28 and replaced with device 10 by inserting air outlet 18 into oil filler port 28.

Figure 5:
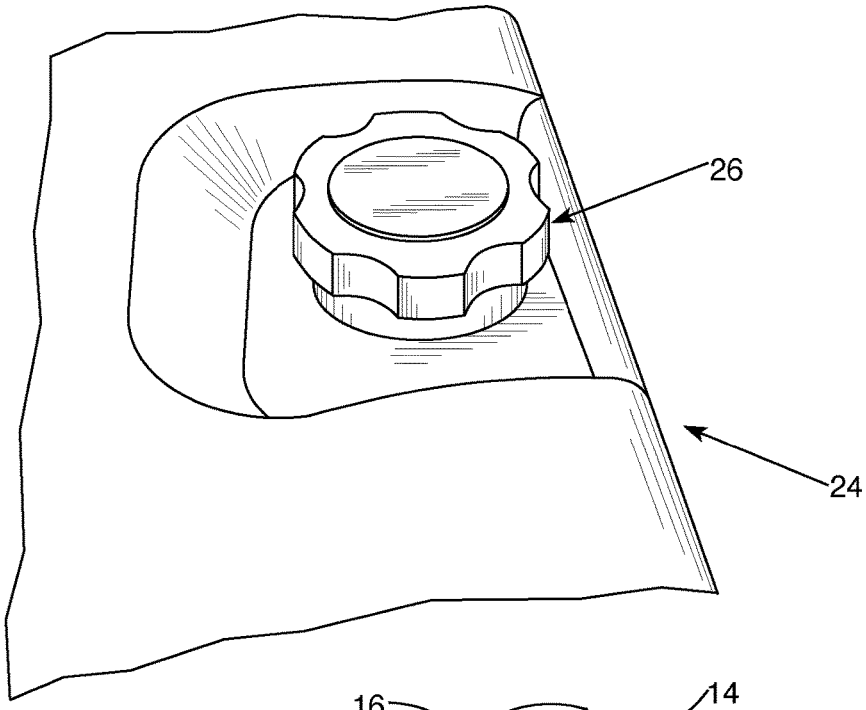
FIG. 5 is a perspective view of an engine with an oil cap inserted into an oil filler port.
Figure 6:
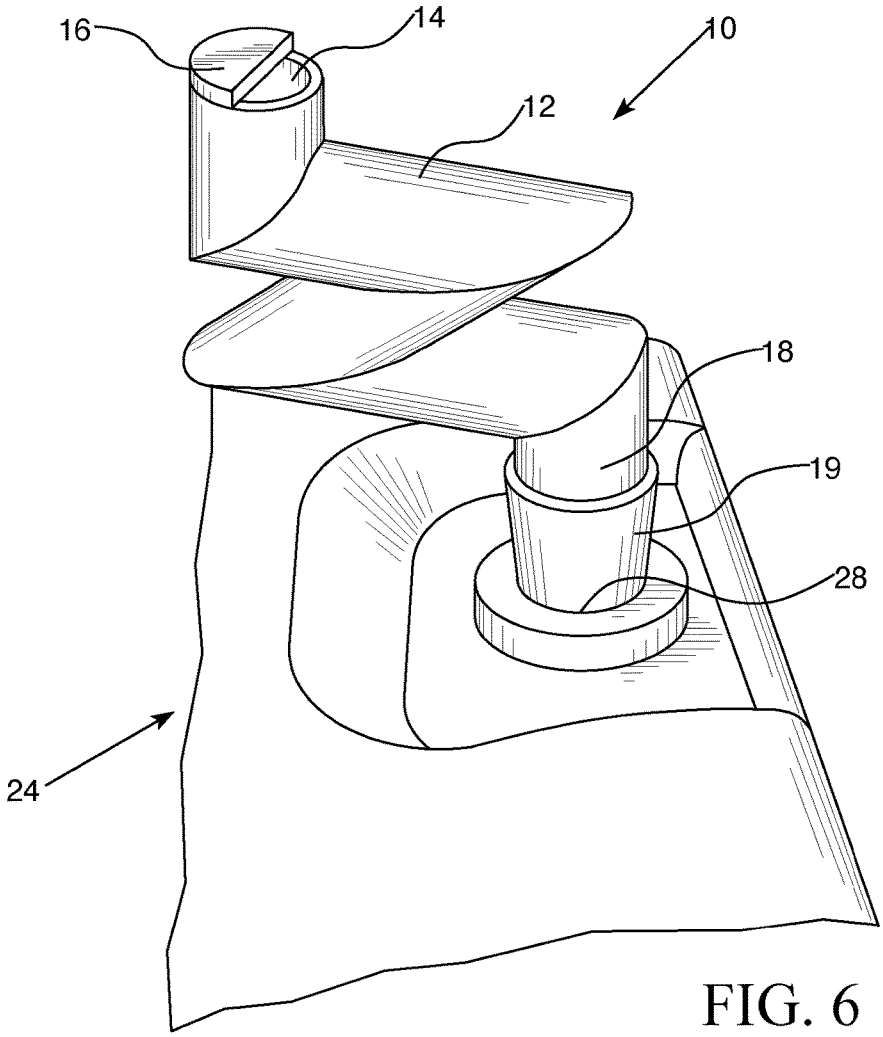
FIG. 6 is a perspective view of the topside of one embodiment inserted into an oil filler port.
Figure 7:
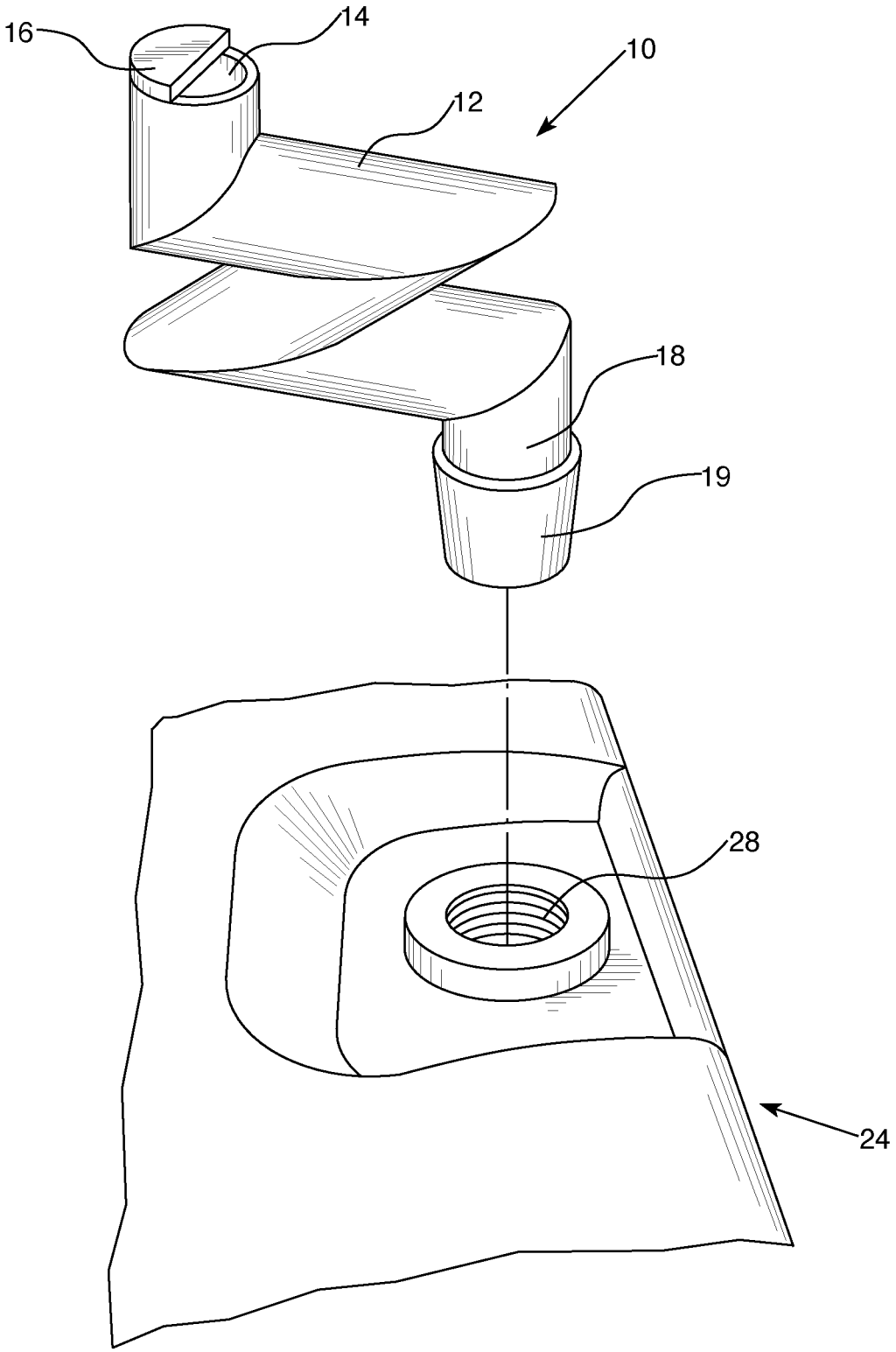
FIG. 7 is an exploded view of one embodiment in relation to an engine and oil filler port.

As shown in FIG. 5-7, in order to install one embodiment of device 10 in a vehicle, the user accesses engine 24 (such as by opening the hood of the vehicle). Next, the user removes the standard oil cap 26 shown in FIG. 5 from oil filler port 28 in the oil system of engine 24 (such as by rotating it and lifting it off of oil filler port 28). Finally, as shown in FIGS. 6 and 7, the user attaches device 10 to oil filler port 28 in engine 24 (such as by inserting or rotating/threading air outlet 18 into oil filler port 28) until device 10 is securely attached to oil filler port 28 and engine 24.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention. For instance, in the embodiments shown in FIGS. 1-4 and 6-8, various combinations of air inlets 16, air outlets 18, and baffles 22 are shown. One of skill in the art would recognize that other combinations of these components (and others described in the specification) can be implemented to form other embodiments.

What is claimed is:

1. An apparatus for improving the efficiency of an engine, comprising:

a tubular chamber comprised of a first end and a second end, said first and second ends being at opposite ends of the tubular chamber, a plurality of tubular angular sections connecting the first end and the second end, a plurality of baffles connected to the inside of the tubular chamber, wherein the baffles are adapted to collect oil droplets from the engine and expel the oil droplets through the second end, a valve located in the tubular chamber and configured to be able to close off the tubular chamber, a controller connected to the valve that can open and close the valve; and a tilt sensor coupled to the controller that senses the angular orientation of the engine;

an air inlet at the first end of the tubular chamber; and an air outlet at the second end of the tubular chamber, wherein the air outlet is adapted to be coupled to an oil filler port connected to the engine.

2. The apparatus of claim 1, wherein the valve is located at the first end of the tubular chamber.

3. The apparatus of claim 1, wherein the valve is located at the second end of the tubular chamber.

4. The apparatus of claim 1, wherein the valve is located between the first end and the second end of the tubular chamber.

5. The apparatus of claim 1, wherein the valve is a butterfly valve.

6. The apparatus of claim 1, wherein in the controller is configured to close the valve when the tilt sensor detects that the engine is inclined by more than 15°.

7. The apparatus of claim 1, further comprising a power sensor coupled to the controller that senses when the engine is on.

8. The apparatus of claim 7, wherein the controller is configured to close the valve when the power sensor detects that the engine is off.

* * * * *